US009940872B2

(12) United States Patent
An et al.

(10) Patent No.: US 9,940,872 B2
(45) Date of Patent: Apr. 10, 2018

(54) DEGRADATION COMPENSATING DEVICE, ORGANIC LIGHT EMITTING DISPLAY DEVICE HAVING THE SAME, AND METHOD FOR DRIVING ORGANIC LIGHT EMITTING DISPLAY DEVICE

(71) Applicant: SAMSUNG DISPLAY CO., LTD., Yongin-si, Gyeonggi-gu (KR)

(72) Inventors: Bo-Young An, Hwaseong-si (KR); Jae-Shin Kim, Seoul (KR); Ho-Suk Maeng, Seoul (KR); Jong-Woong Park, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 99 days.

(21) Appl. No.: 15/184,945

(22) Filed: Jun. 16, 2016

(65) Prior Publication Data

US 2017/0162109 A1 Jun. 8, 2017

(30) Foreign Application Priority Data

Dec. 7, 2015 (KR) ..... 10-2015-0172979

(51) Int. Cl.
*G09G 3/32* (2016.01)
*G09G 3/3208* (2016.01)
*G09G 3/20* (2006.01)

(52) U.S. Cl.
CPC ..... *G09G 3/3208* (2013.01); *G09G 3/2003* (2013.01); *G09G 2320/0242* (2013.01)

(58) Field of Classification Search
None
See application file for complete search history.

(56) References Cited

U.S. PATENT DOCUMENTS

2008/0297449 A1* 12/2008 Yamashita ..... G09G 3/3233 345/76
2016/0307505 A1* 10/2016 Tsuge ..... G09G 3/3233
2017/0169767 A1* 6/2017 Song ..... G09G 3/3291

FOREIGN PATENT DOCUMENTS

KR 10-1310935 B1 9/2013

OTHER PUBLICATIONS

Abstract for Korean Patent Publication No. 1020080075169 A, dated Aug. 14, 2008 corresponding to Korean Patent No. 10-1310935 B1, 1 page.

* cited by examiner

*Primary Examiner* — Joseph Haley
(74) *Attorney, Agent, or Firm* — Lewis Roca Rothgerber Christie LLP

(57) ABSTRACT

A degradation compensating device includes an accumulator configured to accumulate stress data every pixel block, a memory configured to receive the stress data from the accumulator, and to load accumulated data from an external flash memory when a display device power is turned on, the accumulated data being a total sum of the stress data, a compensation factor calculator configured to determine a target compensation factor based on the accumulated data to compensate image data, and to apply an initial compensation factor to the target compensation factor during a wake-up period after loading the accumulated data is completed, the initial compensation factor being changed gradually during the wake-up period, and a data compensator configured to generate image compensation data based on the target compensation factor, and to generate initial image data based on a wake-up factor that is an adjusted target compensation factor based on the initial compensation factor.

20 Claims, 9 Drawing Sheets

FIG. 5

| REGISTER | OPERATION |
|---|---|
| WUP[2:0] | WUP1 = 0:1 FRAME<br>WUP2 = 1:2 FRAMES<br>WUP3 = 2:4 FRAMES<br>WUP4 = 3:8 FRAMES<br>⋮<br>WUP7 = 7:128 FRAME |

DEGRADATION COMPENSATING DEVICE, ORGANIC LIGHT EMITTING DISPLAY DEVICE HAVING THE SAME, AND METHOD FOR DRIVING ORGANIC LIGHT EMITTING DISPLAY DEVICE

CROSS REFERENCE TO RELATED APPLICATION

This application claims priority to and the benefit of Korean Patent Application No. 10-2015-0172979, filed on Dec. 7, 2015 in the Korean Intellectual Property Office (KIPO), the disclosure of which is hereby incorporated by reference herein in its entirety.

BACKGROUND

1. Field

Aspects of the inventive concept relate to display devices

2. Discussion of Related Art

An organic light emitting display device displays images using organic light emitting diodes. Because degradation of the organic light emitting diodes and differences in the threshold voltage/mobility of driving transistors may occur, luminance variations and image blur may be noticeable by a user. Thus, image data compensations are performed to improve display quality.

The organic light emitting display device or an electronic device having the same includes a flash memory for maintaining an accumulation of pixel stress information (i.e., accumulated data). The organic light emitting display device loads the accumulated data from the flash memory and generates a compensation factor based on the accumulated data. In so doing, an image is displayed, and the compensation factor is calculated after the lapse of a specific display time. Accordingly, a compensated image cannot be immediately displayed at the display turn on. The compensated image is displayed after the lapse of a specific display time. Thus, when the organic light emitting display device power is turned on, dramatic change of the image quality between an image displayed at the beginning and the compensated image on which the target compensation factor is fully applied is noticeable to a user.

SUMMARY

Aspects of embodiments of the inventive concept are directed to a degradation compensating device configured to gradually change a compensation factor during a wake-up period after power on of a display device.

Aspects of embodiments of the inventive concept are directed to an organic light emitting display device including the degradation compensating device.

Aspects of embodiments of the inventive concept are directed to a method for driving an organic light emitting display device for gradually changing a compensation factor during a wake-up period after power on.

According to example embodiments of the inventive concept, there is provided a degradation compensating device including: an accumulator configured to accumulate stress data every pixel block; a memory configured to receive the stress data from the accumulator, and to load accumulated data from an external flash memory when a display device power is turned on, the accumulated data being a total sum of the stress data; a compensation factor calculator configured to determine a target compensation factor based on the accumulated data to compensate image data, and to apply an initial compensation factor to the target compensation factor during a wake-up period after loading the accumulated data is completed, the initial compensation factor being changed gradually during the wake-up period; and a data compensator configured to generate image compensation data based on the target compensation factor, and to generate initial image data based on a wake-up factor that is an adjusted target compensation factor based on the initial compensation factor.

In an embodiment, the compensation factor calculator includes: a decoder configured to receive the accumulated data from the memory and to calculate a stress value of each pixel based on the accumulated data; a first calculator configured to calculate the target compensation factor for each pixel based on the stress value; and a second calculator configured to gradually change the initial compensation factor during the wake-up period.

In an embodiment, a compensation ready flag is generated when loading of the accumulated data is completed.

In an embodiment, the wake-up period is started to operate the second calculator, when the compensation ready flag is generated.

In an embodiment, the second calculator includes: a register configured to store a plurality of wake-up periods each having at least one frame; a function controller configured to select one of the wake-up periods and to activate the second calculator based on the compensation ready flag and the accumulated data, and to deactivate the second calculator when the selected wake-up period is terminated; and an initial compensation factor controller configured to increase the initial compensation factor as one or more frames progress based on a number of frames in the selected wake-up period.

In an embodiment, the initial compensation factor is a positive real number less than or equal to 1.

In an embodiment, the initial compensation factor increases at intervals of a frame during the selected wake-up period.

In an embodiment, the data compensator is further configured to apply the wake-up factor to an input image data during the wake-up period to generate initial image data having a compensation value that gradually increases.

In an embodiment, the stress data includes one or more of a display time of the pixel block, a grayscale level of the pixel block, a luminance level of the pixel block, and a temperature of the pixel block that affect degradation of the pixel.

In an embodiment, the memory is configured to provide the stress data generated at the data accumulator to the external flash memory.

According to example embodiments of the inventive concept, there is provided a method for driving an organic light emitting display device, the method including: loading accumulated data from an external flash memory when the organic light emitting display device power is turned on, the accumulated data being a total sum of stress data; generating a compensation ready flag when loading of the accumulated data is completed; determining a target compensation factor based on the accumulated data that is loaded; calculating a wake-up factor that is changed gradually during a wake-up period having a plurality of frames; and generating initial image data based on the wake-up factor during the wake-up period.

In an embodiment, the wake-up period is started when the compensation ready flag is generated.

In an embodiment, calculating the wake-up factor includes: starting the wake-up period; increasing an initial compensation factor as one or more frames progress within the wake-up period; and generating the wake-up factor by applying the initial compensation factor to the target compensation factor.

In an embodiment, the initial compensation factor is a positive real number less than or equal to 1.

In an embodiment, a compensation value of the initial image data gradually increases during the wake-up period as a result of the change of the wake-up factor.

In an embodiment, the method further includes: generating image compensation data based on the target compensation factor when the wake-up period is terminated.

According to example embodiments of the inventive concept, there is provided an organic light emitting display device, including: a display panel including a plurality of pixels; a degradation compensator configured to generate initial image data by gradually changing a target compensation factor during a wake-up period, and to generate image compensation data based on the target compensation factor after the wake-up period; a scan driver configured to provide a scan signal to the display panel; a data driver configured to provide a data signal corresponding to the initial image data or the image compensation data to the display panel; and a timing controller configured to control the degradation compensator, the scan driver, and the data driver.

In an embodiment, the degradation compensator includes: an accumulator configured to accumulate stress data every pixel block; a memory configured to load accumulated data from an external flash memory when the organic light emitting display device power is turned on, the accumulated data being a total sum of the stress data; a compensation factor calculator configured to determine a target compensation factor based on the accumulated data, and to apply an initial compensation factor to the target compensation factor during the wake-up period after loading of the accumulated data is completed, the initial compensation factor being changed gradually during the wake-up period; and a data compensator configured to generate image compensation data by applying the target compensation factor to input image data, and to generate initial image data based on a wake-up factor that is an adjusted target compensation factor based on the initial compensation factor.

In an embodiment, the compensation factor calculator includes: a register configured to store a plurality of wake-up periods each having at least one frame; a function controller configured to select one of the wake-up periods and to activate a second calculator based on a compensation ready flag and the accumulated data, and to deactivate the second calculator when the selected wake-up period is terminated; and an initial compensation factor controller configured to increase the initial compensation factor as one or more frames progress based on a number of frames in the selected wake-up period.

In an embodiment, the initial compensation factor is applied to the target compensation factor during the wake-up period such that a compensation value of the initial image data increases gradually.

Therefore, the degradation compensating device according to example embodiments may include the compensation factor calculator for gradually increasing the wake-up compensation factor to reach the target compensation factor during the wake-up period, such that the image quality may be changed smoothly (e.g., be changed gradually and continuously) during the wake-up period.

In addition, the organic light emitting display device may include the degradation compensating device such that the image quality may be changed smoothly during the wake-up period. Also, the fully compensated image to which the target compensation factor is fully applied may be displayed after the wake-up period. Thus, a dramatic change of the image quality by the time difference between a display start time and the image compensation start time may be prevented or reduced.

Further, the method for driving the organic light emitting display device may smoothly change (e.g., continuously and gradually change) the display quality during the wake-up period. Thus, dramatic change of the image quality by the time difference between a display start time and the image compensation start time may be prevented or reduced.

BRIEF DESCRIPTION OF THE DRAWINGS

Example embodiments can be understood in more detail from the following description taken in conjunction with the accompanying drawings, in which:

FIG. 5 is a diagram illustrating an example of data set in a register included in the second calculator of FIG. 4.

DETAILED DESCRIPTION OF EMBODIMENTS

Exemplary embodiments will be described more fully hereinafter with reference to the accompanying drawings, in which various embodiments are shown.

Figure 1:
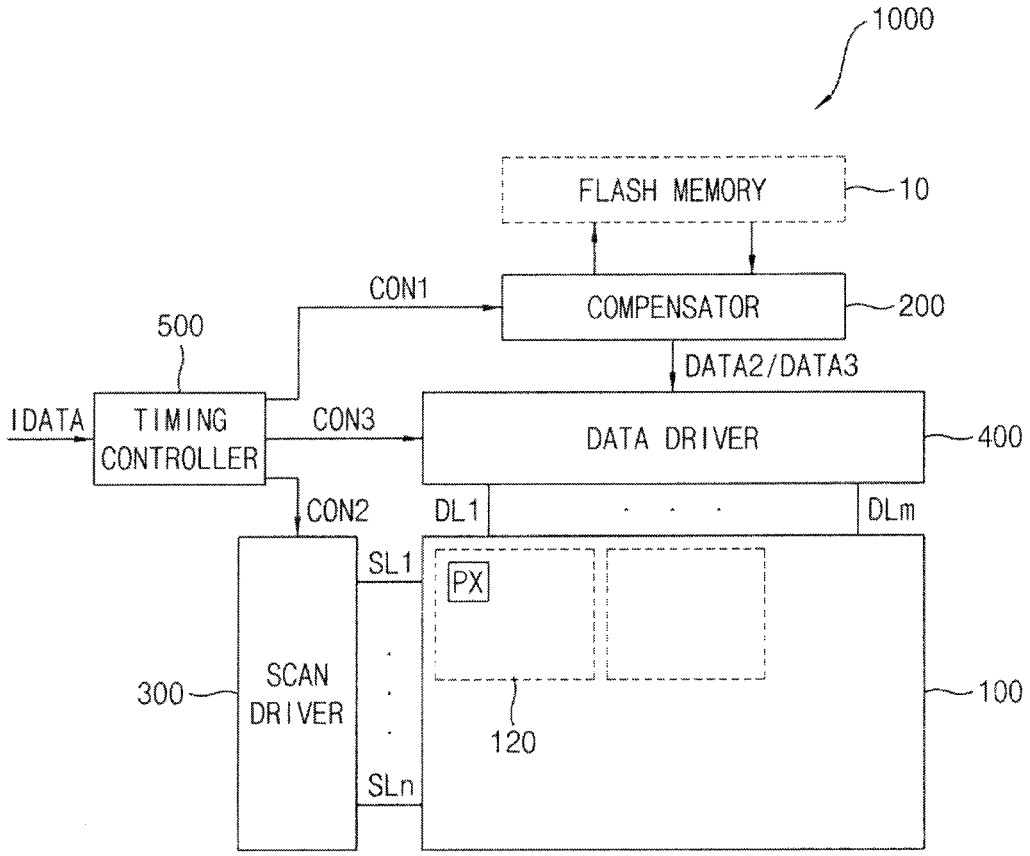
FIG. 1 is a block diagram of an organic light emitting display device according to example embodiments of the inventive concept.

FIG. 1 is a block diagram of an organic light emitting display device according to example embodiments of the inventive concept.

The organic light emitting display device 1000 may include a display panel 100, a degradation compensator 200, a scan driver 300, a data driver 400, and a timing controller 500.

The display panel 100 may include a plurality of pixels PX, which display images. That is, the pixels PX may be respectively arranged at locations corresponding to crossing regions of a plurality of scan lines SL1 through SLn and a plurality of data lines DL1 through DLm. In one embodiment, the display panel 100 may provide stress information of the pixels PX generated by a pixel sensing to the degradation compensator 200. The stress information may include display time, grayscale level, luminance level, temperature of pixels, and/or the like. The stress information may be generated by every pixel block 120.

The degradation compensator 200 may receive a first control signal CON1 from the timing controller 500, and may compensate image data to compensate for the degradation of the pixels PX (or to compensate lifetime of the pixels PX). The degradation compensator 200 may generate initial image data DATA2 during a set or predetermined wake-up period by a gradual change of the target compensation factor. The degradation compensator 200 may generate image compensation data DATA based on the target compensation factor after the wake-up period. In one embodiment, the degradation compensator 200 may accumulate stress information of the pixels PX that are generated by operations of the display panel 100, and may compensate input image data DATA1 based on the accumulated stress information. The wake-up period may define a period for displaying an initial image after accumulated data loading is completed. A compensation factor may increase to reach the target compensation factor during the wake-up period.

In one embodiment, the degradation compensator 200 may include an accumulator configured to accumulate stress data for every pixel block 120, a memory configured to load accumulated data, that is a total sum of the stress data, from an external flash memory 10 when a display device power is turned on, a compensation factor calculator configured to determine the target compensation factor based on the accumulated data to compensate an image data, and to apply an initial compensation factor to the target compensation factor during the wake-up period after the accumulated data loading is completed, and a data compensator configured to generate an image compensation data based on the target compensation factor, and to generate an initial image data based on a wake-up factor that is an adjusted target compensation factor based on the initial compensation factor. The initial compensation factor may be changed gradually and may be applied to the target compensation factor during the wake-up period, such that a compensation value of the initial image data may be changed gradually. The initial image data may correspond to an image displayed in the wake-up period. Accordingly, when the organic light emitting display device 1000 power is turned on, turned-on image may be changed smoothly (e.g., be changed continuously and gradually) during the wake-up period. In addition, the fully compensated image to which the target compensation factor is applied may be displayed after the wake-up period. Thus, a dramatic change of the image quality by a time difference between a display start time and an image compensation start time may be prevented or reduced.

In one embodiment, the degradation compensator 200 may be included in the timing controller 500. In one embodiment, the degradation compensator 200 may be included in the data driver 400.

The scan driver 300 may provide scan signals to the display panel 100 via the scan lines SL1 through SLn. The scan driver 300 may provide the scan signals to the display panel 100 based on a second control signal CON2 received from the timing controller 500.

The data driver 400 may provide data signals to the display panel 100 via the data lines DL1 through DLm. The data driver 400 may provide the data signals to the display panel 100 based on a third control signal CON3 received from the timing controller 500. The data signals may correspond to the initial image data DATA2 and/or the image compensation data DATA3.

The timing controller 500 may receive input image data IDATA from an external graphic source and control the degradation compensator 200, the scan driver 300, and the data driver 400. The timing controller 500 may generate the first, second, and third control signals CON1, CON2, and CON3, and may provide the first, second, and third control signals CON1, CON2, and CON3 to the degradation compensator 200, the scan driver 300, and the data driver 400, respectively.

Figure 2:
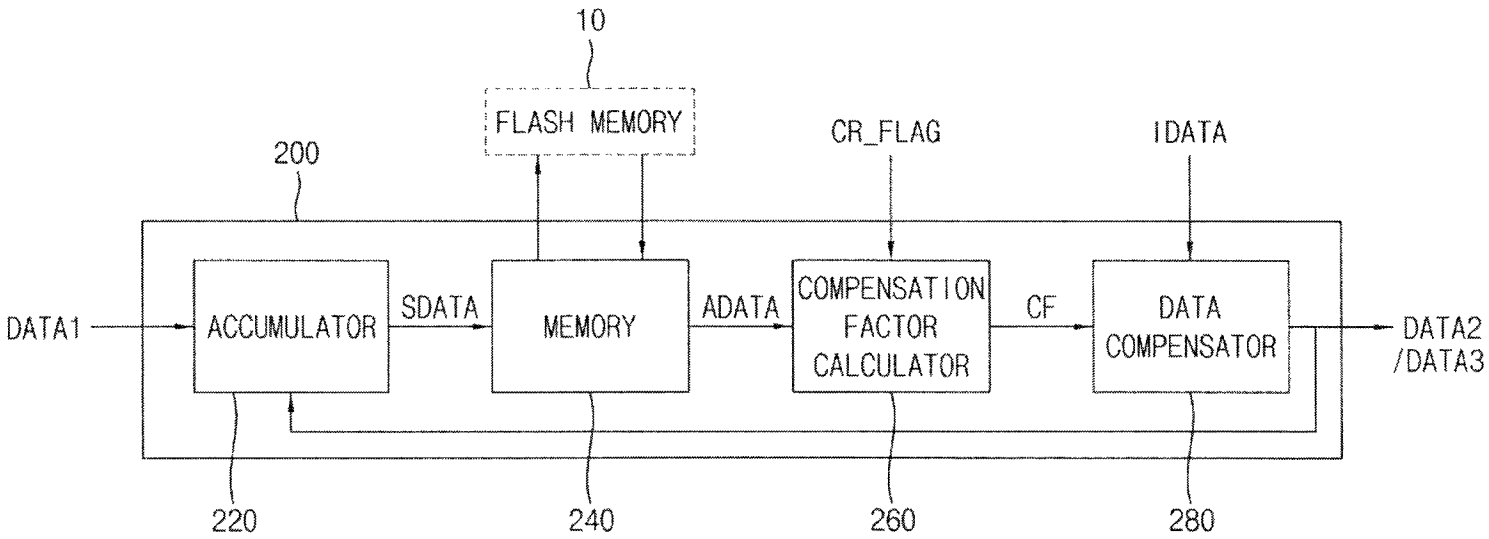
FIG. 2 is a block diagram of a degradation compensating device according to example embodiments of the inventive concept.

FIG. 2 is a block diagram of a degradation compensating device according to example embodiments of the inventive concept.

Referring to FIG. 2, the degradation compensating device 200 may include an accumulator 220, a memory 240, a compensation factor calculator 260, and a data compensator 280. The degradation compensating device 200 may be used to compensate for degradation of pixels or to improve a lifetime of the pixels.

In one embodiment, the degradation compensating device 200 may be embedded in a driver integrated circuit (IC) of an organic light emitting display device.

The accumulator 220 may accumulate stress data SDATA based on stress information DATA1 from every pixel block. In one embodiment, the stress information DATA1 or the stress data SDATA may be included in image data that is provided from a data driver. In one embodiment, the stress information DATA1 or the stress data SDATA may be included in sensing data for sensing the degradation of a display panel. In one embodiment, the stress data SDATA may include display time, grayscale level, luminance level, temperature of pixels, and/or the like, which affect the degradation of the pixel. The stress data SDATA may be provided to the memory 240.

The memory 240 may receive the stress data SDATA from the accumulator 220. The memory 240 may provide the stress data SDATA to the compensation factor calculator 260 and an external flash memory 10 with the organic light emitting display device and/or the driver IC including the degradation compensating device 200. For example, the memory 240 may provide the stress data SDATA to the flash memory in real time or periodically.

The memory may be a volatile memory having rapid (or fast) driving speed. For example, the memory 240 may include static random access memory (SRAM).

The flash memory 10 may store the stress data SDATA received from the memory 240. Thus, when the organic light emitting display device or the driver IC power is turned on, the memory 240 may load accumulated data ADATA from the flash memory 10. The accumulated data ADATA may be a total sum of the stress data SDATA. The memory 240 may provide the accumulated data ADATA loaded from the memory (e.g., flash memory) 240 to the compensation factor calculator 260. After the accumulated data loading is terminated, image display of the organic light emitting display device and compensating operation of the degradation compensating device 200 may be started. Because very large size accumulated data ADATA is loaded, a time difference between a display start time and an image compensation start time may be generated. Accordingly, a compensation factor CF may be generated after the display is started. Thus, a compensated image based on the compensation factor CF may be displayed after the lapse of a specific display time. Especially, as display resolution of the organic light emitting display device or using time (e.g., on time) of the organic light emitting display device increases, the accumulated data ADATA may increase such that a calculation time for the compensation factor CF may increase.

The compensation factor calculator 260 may determine a target compensation factor based on the accumulated data ADATA to compensate image data. The compensation factor calculator 260 may apply an initial compensation factor to the target compensation factor during a set or predetermined wake-up period after the accumulated data ADATA loading is completed. The initial compensation factor may be changed gradually during the wake-up period. In other words, the compensation factor calculator 260 may calculate a wake-up factor, which is an adjusted target compensation factor based on the initial compensation factor, during the wake-up period.

In one embodiment, the compensation factor calculator 260 may include a decoder configured to receive the accumulated data ADATA from the memory 240 and to calculate a stress value of each pixel based on the accumulated data ADATA, a first calculator configured to calculate the target compensation factor for each pixel based on the stress value, and a second calculator configured to gradually change the initial compensation factor during the wake-up period.

The initial compensation factor may be gradually increased in stages as a frame passes (e.g., during a frame or as one or more frames progress) in the wake-up period. In one embodiment, the initial compensation factor may be a positive real number less than or equal to 1. For example, the initial compensation factor may be gradually increased from $1/128$ to 1 during the wake-up period. Accordingly, the wake-up factor may increase in stages such that the image compensation may be performed smoothly (e.g., be performed continuously and gradually).

In one embodiment, a compensation ready flag CR_FLAG may be generated when the accumulated data ADATA loading is completed. The wake-up period may be started, to operate the second calculator, when the compensation ready flag CR_FLAG is generated. The wake-up factor may be calculated during a certain time immediately after the accumulated data ADATA loading completion.

The data compensator 280 may generate image compensation data DATA3 based on the target compensation factor. The data compensator 280 may generate initial image data DATA2 based on the wake-up factor during the wake-up period. The image compensation data DATA3 may be compensated image data, which is generated by the target compensation factor TCF being applied to the input image data IDATA. The initial image data DATA2 may be compensated image data, which is generated by the wake-up factor being applied to the input image data IDATA. In one embodiment, the data compensator 280 may apply the wake-up factor to the input image data IDATA during the wake-up period such that the compensation value of the initial image data DATA2 may be changed gradually during the wake-up period.

The initial image data DATA2 and the image compensation data DATA3 may be provided to a data driver of the organic light emitting display device. In addition, the image compensation data DATA3 may be provided to the accumulator 220 again (i.e., may be fed back to the accumulator 220). In such an embodiment, the accumulator 220 may accumulate the stress information corresponding to the image compensation data DATA3.

Accordingly, the degradation compensating device 200 may include the compensation factor calculator 260 for increasing (or changing) the wake-up factor to reach the target compensation factor during the wake-up period, such that the image quality may be changed smoothly (e.g., be changed continuously and gradually) during the wake-up period. In addition, the fully compensated image to which the target compensation factor is applied may be displayed after the wake-up period. Thus, a dramatic change of the image quality by the time difference between a display start time and the image compensation start time may be prevented or reduced.

Figure 3:
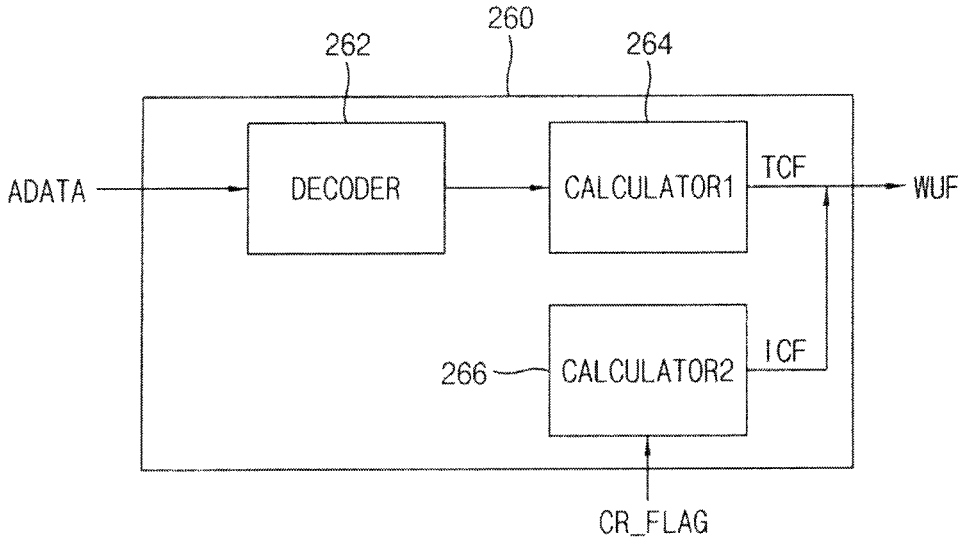
FIG. 3 is a block diagram illustrating an example of a compensation factor calculator in the degradation compensating device of FIG. 2.

FIG. 3 is a block diagram illustrating an example of a compensation factor calculator in the degradation compensating device of FIG. 2.

Referring to FIGS. 2 and 3, the compensation factor calculator 260 may include a decoder 262, a first calculator 264, and a second calculator 266.

The decoder 262 may receive the accumulated data ADATA from the memory 240 and may calculate a stress value of each pixel based on the accumulated data ADATA. Because the accumulated data ADATA include stress information of each pixel block, the decoder 262 may calculate the stress values of each pixel. For example, the decoder 262 may perform an interpolation of the accumulated data ADATA between adjacent pixel blocks so as to calculate the stress value of each pixel.

The first calculator 264 may calculate the target compensation factor TCF for each pixel based on the stress value. The target compensation factor TCF may correspond to a compensation value that is applied to the input image data after the wake-up period. The target compensation factor TCF may be a digitized value for compensating the input image data. For example, when an efficiency of an organic light emitting diode in a pixel is reduced, the target compensation factor TCF may scale the input image data to compensate for the reduced efficiency of the organic light emitting diode. The first calculator 264 may be implemented by various suitable constitutions or algorithms that calculate the target compensation factor TCF using the accumulated data ADATA.

The second calculator 266 may gradually change the initial compensation factor ICF during the wake-up period. In one embodiment, the second calculator 266 may operate by the compensation ready flag CR_FLAG. For example, the wake-up period may be started, to operate the second calculator 266, when the compensation ready flag CR_FLAG is generated. The operation of the second calculator 266 may be stopped when the wake-up period is terminated. That is, the second calculator 266 may operate only within the wake-up period. The wake-up period may define a period for displaying an initial image after the accumulated data ADATA loading is completed. The compensation factor may increase to reach the target compensation factor TCF during the wake-up period. The initial compensation factor ICF may be applied to the target compensation factor TCF by the second calculator 266 such that the wake-up factor WUF may be calculated. The wake-up factor WUF may increase in stages (or gradually) as a frame passes (e.g., during a frame or as one or more frames progress). The wake-up factor WUF may be applied to the input image data IDATA such that the quality of the image in the wake-up period may be changed smoothly (e.g., be changed continuously and gradually).

The constitutions and operations of the second calculator 266 will be described in further detail with reference to FIGS. 4 through 7.

Figure 4:
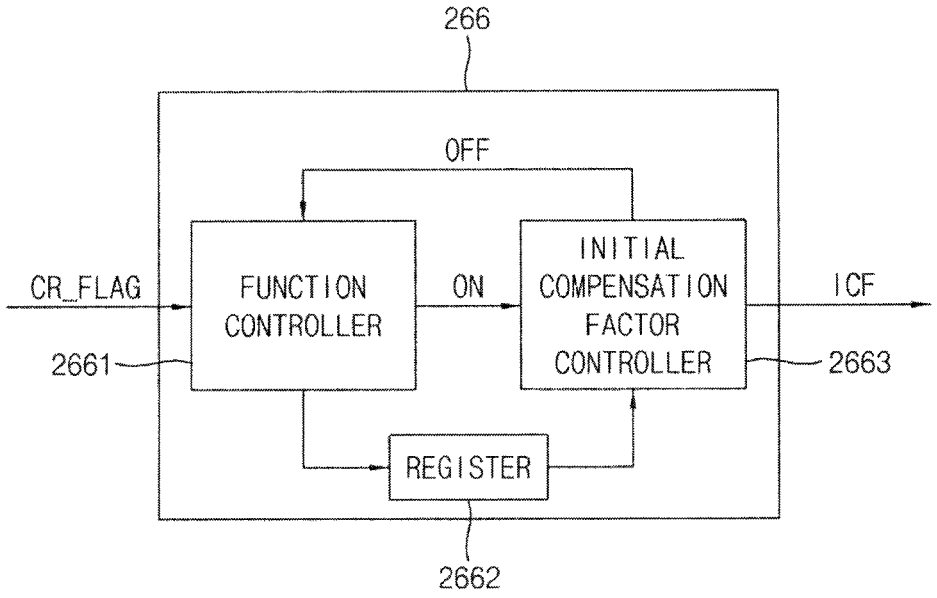
FIG. 4 is a block diagram illustrating an example of a second calculator in the compensation factor calculator of FIG. 3.

FIG. 4 is a block diagram illustrating an example of a second calculator in the compensation factor calculator of FIG. 3. FIG. 5 is a diagram illustrating an example of a data set in a register included in the second calculator of FIG. 4.

Referring to FIGS. 2 through 5, the second calculator 266 may include a function controller 2661, a register 2662, and an initial compensation factor controller 2663.

The function controller 2661 may select one of a plurality of wake-up periods based on the compensation ready flag CR_FLAG and the accumulated data ADATA. In addition, the function controller 2661 may activate the second calculator 266 based on the compensation ready flag CR_FLAG. Thus, the wake-up period may be started and the initial compensation factor controller 2663 may output the initial compensation factor ICF. When the selected wake-up period is terminated, the function controller 2661 may deactivate the second calculator 266. Accordingly, the second calculator 266 may operate only the wake-up period that is a set or predetermined period immediately after display power on. The second calculator 266 may be deactivated after the wake-up period.

The register 2662 may store the plurality of set or predetermined wake-up periods each having at least one frame. In one embodiment, as illustrated in FIG. 5, the register may include 3-bit wake-up periods WUP1 through WUP7. The number of frames of the wake-up periods WUP1 through WUP7 may be different from each other. For example, a first wake-up period WUP1 may have one frame and a seventh wake-up period WUP7 may have 128 frames. The number of frames may increases by $2^k$ as the wake-up period number (e.g., WUP1 through WUP7) increases by k. However, these are examples, and the number of wake-up period and the number of frames in each wake-up period are not limited thereto.

In one embodiment, one of the wake-up periods WUP1 through WUP7 may be selected based on the accumulated data ADATA. As the compensation amount for compensating the input image data IDATA increases, a length of the wake-up period may increase. For example, one of the wake-up periods WUP1 through WUP7 may be selected based on the using time of the pixel.

Figure 7:
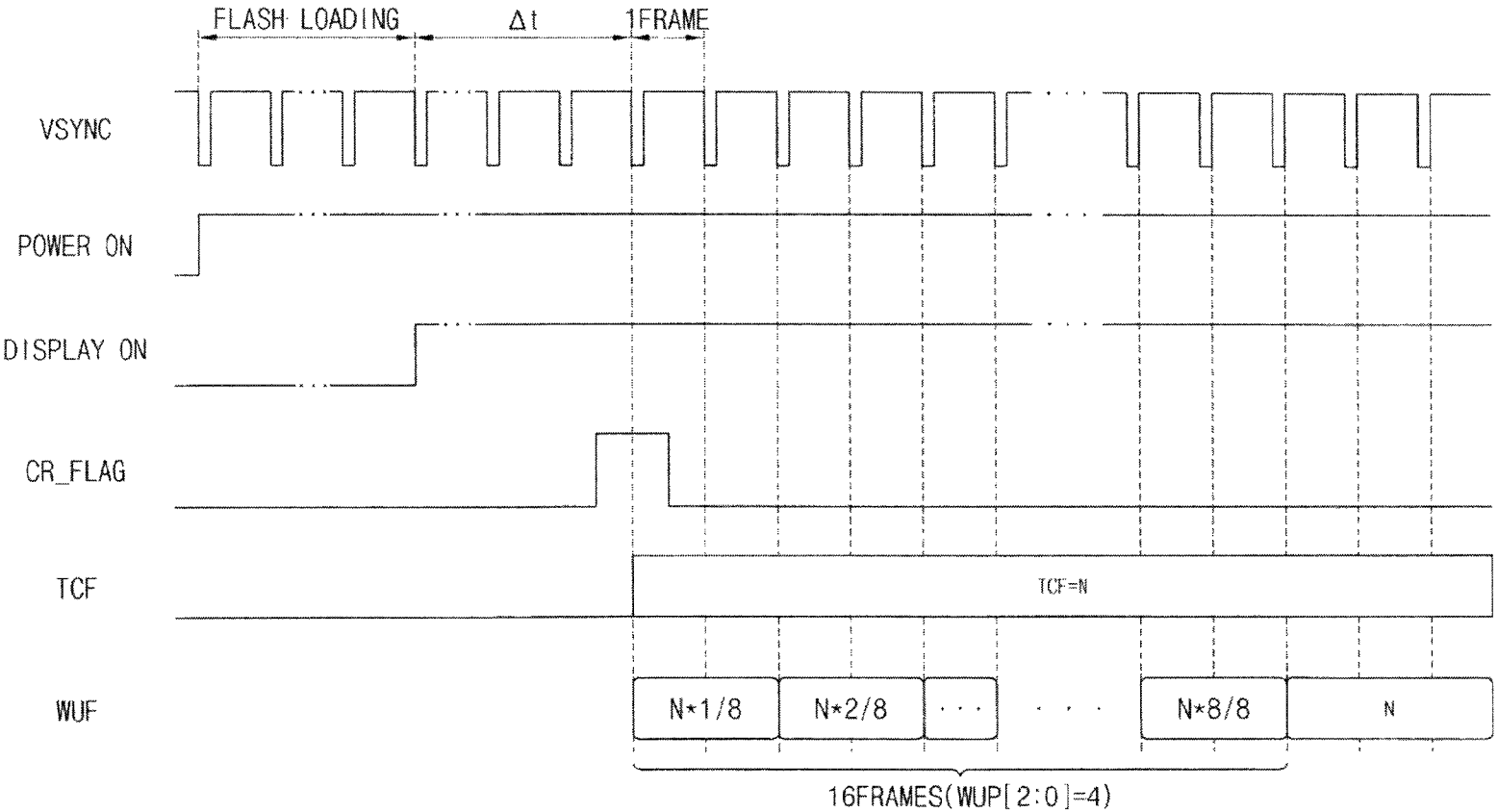
FIG. 7 is a diagram illustrating another example of an operation of the degradation compensating device of FIG. 2.

The initial compensation factor controller 2663 may increase the initial compensation factor ICF as a frame passes (e.g., during a frame or as one or more frames progress) based on the number of frames included in the selected wake-up period. In one embodiment, the initial compensation factor ICF may be a positive real number less than or equal to 1. In one embodiment, the initial compensation factor ICF may increase at intervals of a set or predetermined frame during the selected wake-up period. For example, the initial frame factor ICF may increase every frame within the selected wake-up period, or may increase 2 frame intervals within the selected wake-up period. For example, when a fourth wake-up period WUP4 having 8 frames is selected from the register 2662, the initial compensation factor ICF may increase every frame from ⅛ to 1 (e.g., ⅛, ⅜, ⅜, . . . , ⅞, 1) within the 8 frames (e.g., as illustrated in FIG. 7). However, these are examples, and intervals of increase of the initial compensation factor ICF, values of the initial compensation factor ICF, and/or the like are not limited thereto.

In one embodiment, the wake-up factor WUF may correspond to a multiplication of the initial compensation factor ICF and the target compensation factor TCF. Accordingly, the wake-up factor may increase proportional to the increase of the initial compensation factor ICF during the selected wake-up period. The data compensator 280 may apply the increasing wake-up factor WUF to the input image data IDATA to generate the initial image data. Thus, the image quality may be changed smoothly (e.g., be changed continuously and gradually) during the wake-up period. In addition, the fully compensated image to which the target compensation factor TCF is applied may be displayed after the wake-up period is terminated.

Figure 6:
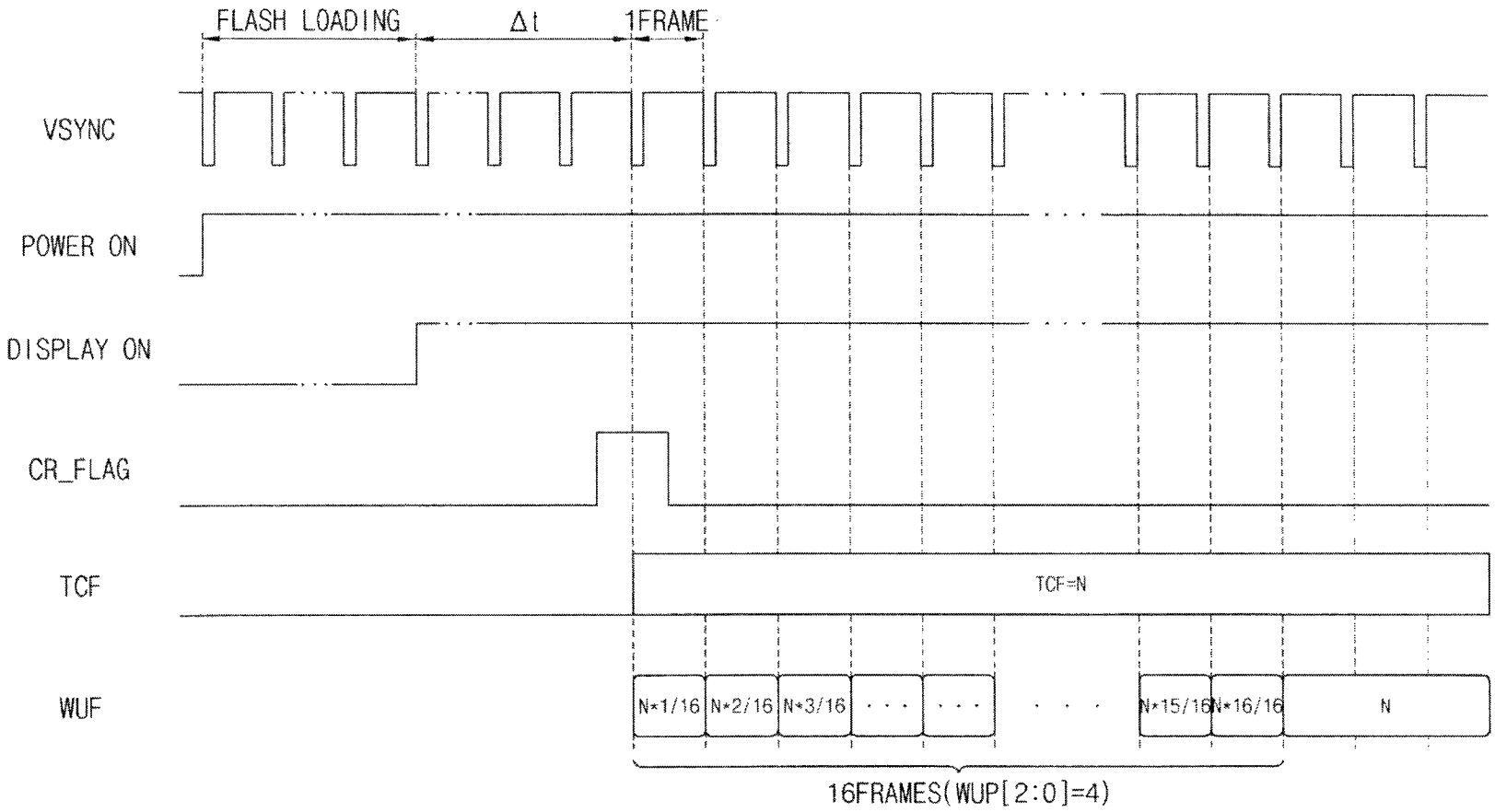
FIG. 6 is a diagram illustrating an example of an operation of the degradation compensating device of FIG. 2.

FIG. 6 is a diagram illustrating an example of an operation of the degradation compensating device of FIG. 2. FIG. 7 is a diagram illustrating another example of an operation of the degradation compensating device of FIG. 2.

Referring to FIGS. 2 through 7, the wake-up factor WUF may be calculated (or generated) during the wake-up period after the display turns on.

When the display device power is turned on (e.g., POWER ON in FIGS. 6 and 7), the memory 240 in the degradation compensator 200 (i.e., the degradation compensating device) may load the accumulated data ADATA from the external flash memory for a specific time. When the accumulated data ADATA loading (e.g., FLASH LOADING in FIGS. 6 and 7) is completed, the display may be turned on (e.g., DISPLAY ON in FIGS. 6 and 7) and the compensation ready flag CR_FLAG may be generated. In one embodiment, the target compensation factor TCF and the compensation ready flag CR_FLAG may be generated after the lapse of a specific display time (e.g., Δt in FIGS. 6 and 7). Because calculating the target compensation factor TCF occurs at a specific time, the image compensation for the display may be not performed immediately. Therefore, a time difference At between a display start time and an image compensation start time may occur.

The target compensation factor TCF may be quantified by N. The calculated target compensation factor TCF may be applied to the input image data IDATA after the wake-up period WUP. The wake-up period WUP may be started when the compensation ready flag CR_FLAG is generated. The second calculator 260 may select a proper wake-up period WUP based on the accumulated data ADATA (i.e., based on amount of compensation). For example, as illustrated in FIGS. 6 and 7, the wake-up period WUP may have 16 frames. Here, the second calculator 266 may gradually increase the initial compensation factor ICF. For example, as illustrated in FIG. 6, the initial compensation factor ICF may increase every frame from 1/16 to 1 (e.g., 1/16, 2/16, 3/16, . . . , 15/16, 1) within the 16 frames as one or more frames progress. Thus, the wake-up factor WUP may increase from N*1/16 to N (e.g., N*1/16, N*2/16, N*3/16, . . . , N*15/16, N) during the wake-up period WUP. Accordingly, the compensation value may be gradually increased by the wake-up factor WUF in the wake-up period WUP such that the initial image quality may be changed smoothly (e.g., be changed continuously and gradually). The target compensation factor TCF may be applied to the input image data IDATA after the wake-up period WUP.

As illustrated in FIG. 7, the initial compensation factor ICF may increase 2 frame intervals within the wake-up period WUP. For example, the initial compensation factor ICF may increase from ⅛ to 1 (e.g., ⅛, ⅜, ⅜, . . . , ⅞, 1) within the 16 frames as one or more frames progress. Thus, the wake-up factor WUP may increase from N*⅛ to N (e.g., N*⅛, N*⅜, N*⅜, . . . , N*⅞, N) during the wake-up period WUP.

Figure 8:
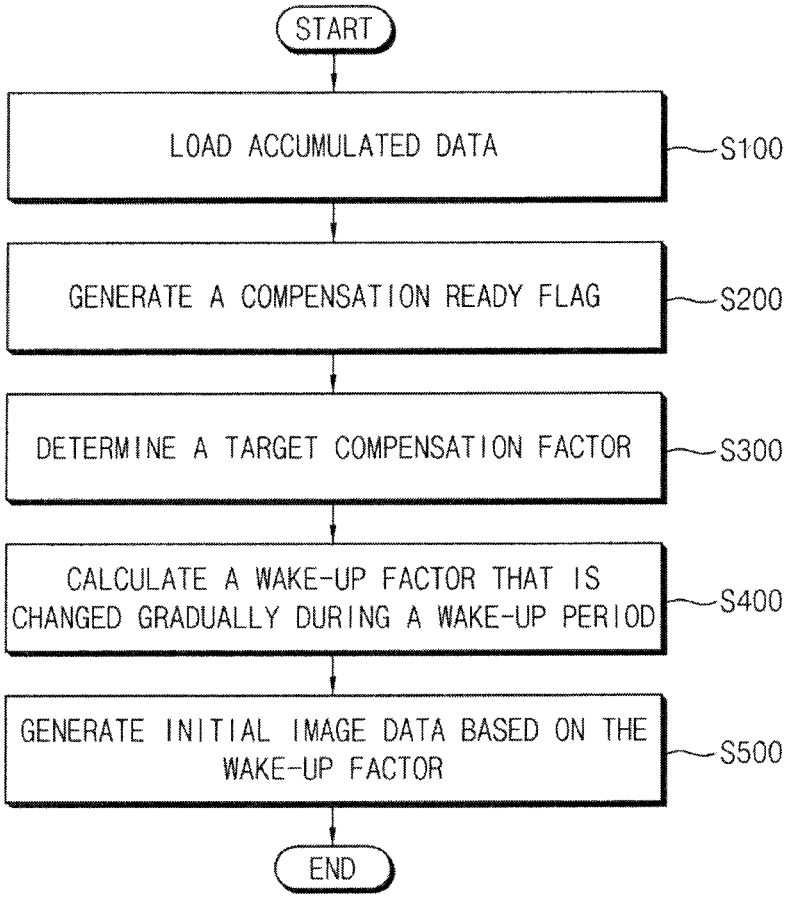
FIG. 8 is a flow diagram of a method for driving an organic light emitting display device according to example embodiments of the inventive concept.
Figure 9:
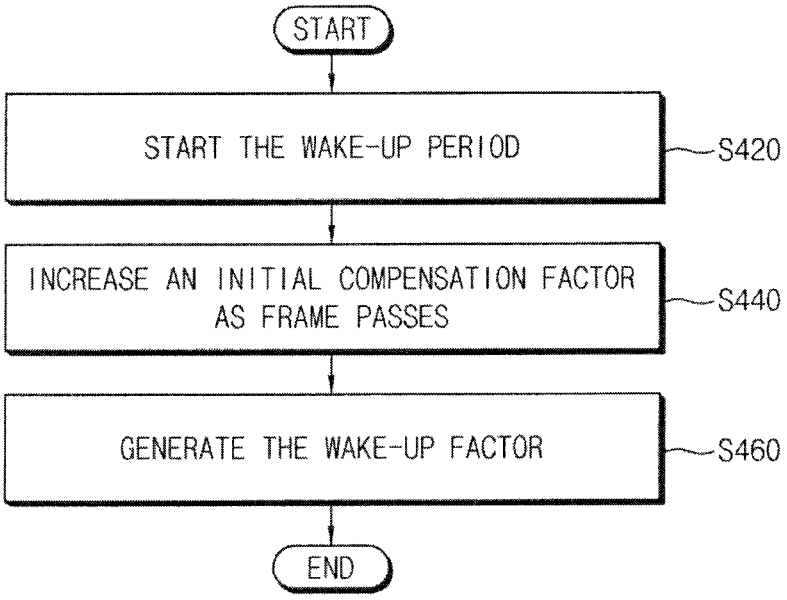
FIG. 9 is a flow diagram illustrating an example of a method for generating a wake-up factor included in the method of FIG. 8.
Figure 10:
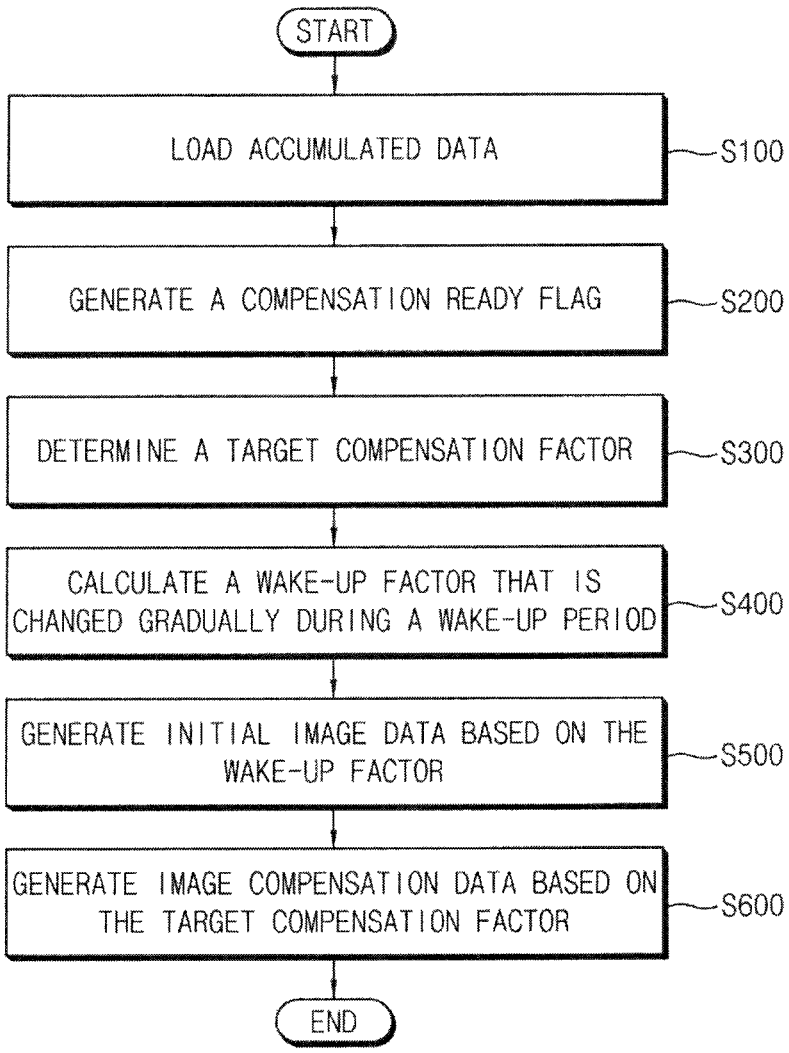
FIG. 10 is a flow diagram illustrating an example of a method for driving the organic light emitting display device of FIG. 8.

FIG. 8 is a flow diagram of a method for driving an organic light emitting display device according to example embodiments of the inventive concept. FIG. 9 is a flow diagram illustrating an example of a method for generating a wake-up factor included in the method of FIG. 8. FIG. 10 is a flow diagram illustrating an example of a method for driving the organic light emitting display device of FIG. 8.

Referring to FIGS. 8 through 10, the method for driving the organic light emitting display device may include loading accumulated data from an external flash memory when the organic light emitting display device power is turned on (S100), generating a compensation ready flag (S200), determining a target compensation factor based on the accumulated data that is loaded (S300), calculating a wake-up factor that is changed gradually during a wake-up period (S400), and generating initial image data based on the wake-up factor during the wake-up period (S500).

The accumulated data may be loaded from the external flash memory when the organic light emitting display device power is turned on (S100). The accumulated data may be a total sum of stress data. The stress data may be generated by a drive of the organic light emitting display device. Because very big size accumulated data is loaded, a time difference between a display start time and an image compensation start time may occur.

The compensation ready flag may be generated when the accumulated data loading is completed (S200), and the target compensation factor may be calculated based on the accumulated data that is loaded (S300). In one embodiment, the compensation ready flag may be generated after the target compensation factor is calculated. The wake-up period may be started when the compensation ready flag is generated.

Then, the wake-up factor that is changed gradually during the wake-up period having a plurality of frames may be calculated (S400). The wake-up period may define a period for displaying an initial image after the accumulated data loading is completed. The compensation factor may increase to reach the target compensation factor during the wake-up period. In one embodiment, the wake-up factor may be an adjusted target compensation factor based on the initial compensation factor. As illustrated in FIG. 9, the wake-up period may be started by the compensation ready flag (S420), an initial compensation factor may be increased as a frame passes (e.g., during a frame or as one or more frames progress) within the wake-up period (S440), and the wake-up factor may be generated by applying the initial compensation factor to the target compensation factor (S460). In one embodiment, the initial compensation factor may be a positive real number less than or equal to 1. In addition, the initial compensation factor may gradually increase during the wake-up period. Thus, the wake-up factor may gradually increase during the wake-up period.

The initial image data may be generated based on the wake-up factor during the wake-up period (S500). Thus, a compensation value of the initial image data may gradually increase during the wake-up period as a result of the change of the wake-up factor. The initial image data may correspond to an image displayed during the wake-up period. Thus, the image quality may be smoothly changed (e.g., be changed continuously and gradually) during the wake-up period.

In one embodiment, as illustrated in FIG. 10, the method for driving the organic light emitting display device may further include generating image compensation data based on the target compensation factor (S600). The image compensation data may be generated based on the target compensation factor after the wake-up period. Here, the generation of the initial compensation factor and the wake-up factor may be stopped. Thus, the fully compensated image to which the target compensation factor is applied may be displayed after the wake-up period.

Because the operations and constitutions of the organic light emitting display device are described above in reference to FIGS. 1 through 7, duplicated descriptions may not be repeated.

As described above, the method for driving the organic light emitting display device may apply the wake-up factor that is changed gradually during the wake-up period to the input image data after the organic light emitting display device power is turned on. Thus, the image quality may be smoothly changed (e.g., be continuously and gradually changed) during the wake-up period, and a dramatic change of the image quality by the time difference between a display start time and the image compensation start time may be prevented or reduced.

The present embodiments may be applied to any suitable display device and any system including the display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, and/or the like.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112, first paragraph, and 35 U.S.C. § 132(a).

The display device and/or any other relevant devices or components according to embodiments of the inventive concept described herein, such as the compensator, the flash memory, and the timing, data, and scan drivers, may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the inventive concept.

The foregoing is illustrative of example embodiments, and is not to be construed as limiting thereof. Although a few example embodiments have been described, those skilled in the art will readily appreciate that many suitable modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the inventive concept, which is defined by the following claims, with equivalents thereof.

What is claimed is:

1. A degradation compensating device comprising:

an accumulator configured to accumulate stress data every pixel block;

a memory configured to receive the stress data from the accumulator, and to load accumulated data from an external flash memory when a display device power is turned on, the accumulated data being a total sum of the stress data;

a compensation factor calculator configured to determine a target compensation factor based on the accumulated data to compensate image data, and to apply an initial compensation factor to the target compensation factor during a wake-up period after loading the accumulated data is completed, the initial compensation factor being changed gradually during the wake-up period; and a data compensator configured to generate image compensation data based on the target compensation factor, and to generate initial image data based on a wake-up factor that is an adjusted target compensation factor based on the initial compensation factor.

2. The degradation compensating device of claim 1, wherein the compensation factor calculator comprises:

a decoder configured to receive the accumulated data from the memory and to calculate a stress value of each pixel based on the accumulated data;

a first calculator configured to calculate the target compensation factor for each pixel based on the stress value; and a second calculator configured to gradually change the initial compensation factor during the wake-up period.

3. The degradation compensating device of claim 2, wherein a compensation ready flag is generated when loading of the accumulated data is completed.

4. The degradation compensating device of claim 3, wherein the wake-up period is started to operate the second calculator, when the compensation ready flag is generated.

5. The degradation compensating device of claim 3, wherein the second calculator comprises:

a register configured to store a plurality of wake-up periods each having at least one frame;

a function controller configured to select one of the wake-up periods and to activate the second calculator based on the compensation ready flag and the accumulated data, and to deactivate the second calculator when the selected wake-up period is terminated; and an initial compensation factor controller configured to increase the initial compensation factor as one or more frames progress based on a number of frames in the selected wake-up period.

6. The degradation compensating device of claim 5, wherein the initial compensation factor is a positive real number less than or equal to 1.

7. The degradation compensating device of claim 6, wherein the initial compensation factor increases at intervals of a frame during the selected wake-up period.

8. The degradation compensating device of claim 2, wherein the data compensator is further configured to apply the wake-up factor to an input image data during the wake-up period to generate initial image data having a compensation value that gradually increases.

9. The degradation compensating device of claim 1, wherein the stress data comprises one or more of a display time of the pixel block, a grayscale level of the pixel block, a luminance level of the pixel block, and a temperature of the pixel block that affect degradation of a corresponding pixel.

10. The degradation compensating device of claim 1, wherein the memory is configured to provide the stress data generated at the accumulator to the external flash memory.

11. A method for driving an organic light emitting display device, the method comprising:

loading accumulated data from an external flash memory when the organic light emitting display device power is turned on, the accumulated data being a total sum of stress data;

generating a compensation ready flag when loading of the accumulated data is completed;

determining a target compensation factor based on the accumulated data that is loaded;

calculating a wake-up factor that is changed gradually during a wake-up period having a plurality of frames; and generating initial image data based on the wake-up factor during the wake-up period.

12. The method of claim 11, wherein the wake-up period is started when the compensation ready flag is generated.

13. The method of claim 12, wherein calculating the wake-up factor comprises:

starting the wake-up period;

increasing an initial compensation factor as one or more frames progress within the wake-up period; and generating the wake-up factor by applying the initial compensation factor to the target compensation factor.

14. The method of claim 13, wherein the initial compensation factor is a positive real number less than or equal to 1.

15. The method of claim 11, wherein a compensation value of the initial image data gradually increases during the wake-up period as a result of the change of the wake-up factor.

16. The method of claim 11, further comprising:

generating image compensation data based on the target compensation factor when the wake-up period is terminated.

17. An organic light emitting display device, comprising:

a display panel comprising a plurality of pixels;

a degradation compensator configured to generate initial image data by gradually changing a target compensation factor during a wake-up period, and to generate image compensation data based on the target compensation factor after the wake-up period;

a scan driver configured to provide a scan signal to the display panel;

a data driver configured to provide a data signal corresponding to the initial image data or the image compensation data to the display panel; and a timing controller configured to control the degradation compensator, the scan driver, and the data driver.

18. The organic light emitting display device of claim 17, wherein the degradation compensator comprises:

an accumulator configured to accumulate stress data every pixel block;

a memory configured to load accumulated data from an external flash memory when the organic light emitting display device power is turned on, the accumulated data being a total sum of the stress data;

a compensation factor calculator configured to determine a target compensation factor based on the accumulated data, and to apply an initial compensation factor to the target compensation factor during the wake-up period after loading of the accumulated data is completed, the initial compensation factor being changed gradually during the wake-up period; and a data compensator configured to generate image compensation data by applying the target compensation factor to input image data, and to generate initial image data based on a wake-up factor that is an adjusted target compensation factor based on the initial compensation factor.

19. The organic light emitting display device of claim 18, wherein the compensation factor calculator comprises:

a register configured to store a plurality of wake-up periods each having at least one frame;

a function controller configured to select one of the wake-up periods and to activate a second calculator based on a compensation ready flag and the accumulated data, and to deactivate the second calculator when the selected wake-up period is terminated; and an initial compensation factor controller configured to increase the initial compensation factor as one or more frames progress based on a number of frames in the selected wake-up period.

20. The organic light emitting display device of claim 18, wherein the initial compensation factor is applied to the target compensation factor during the wake-up period such that a compensation value of the initial image data increases gradually.

* * * * *